US010570533B1

(12) United States Patent
Hoover

(10) Patent No.: US 10,570,533 B1
(45) Date of Patent: Feb. 25, 2020

(54) SAFETY GUARD FOR TEXTILE MACHINES

(71) Applicant: American Linc, LLC, Gastonia, NC (US)

(72) Inventor: Donald Lynn Hoover, Clover, SC (US)

(73) Assignee: American Linc, LLC, Gastonia, NC (US)

( * ) Notice: Subject to any disclaimer, the term of this patent is extended or adjusted under 35 U.S.C. 154(b) by 21 days.

(21) Appl. No.: 15/819,608

(22) Filed: Nov. 21, 2017

Related U.S. Application Data

(60) Provisional application No. 62/424,808, filed on Nov. 21, 2016.

(51) Int. Cl.
*D01H 13/14* (2006.01)
*D01H 13/04* (2006.01)

(52) U.S. Cl.
CPC ..... *D01H 13/14* (2013.01); *D01H 13/04* (2013.01)

(58) Field of Classification Search
CPC .. D01H 3/04; D01H 3/12; D01H 3/14; D01H 1/42; B65H 57/02
USPC ..... 57/279, 112, 352, 357, 264
See application file for complete search history.

(56) References Cited

U.S. PATENT DOCUMENTS 4,116,395 A * 9/1978 Courvoisier ..... B65H 67/04 242/473.7
4,300,340 A * 11/1981 Pozzo ..... D01H 13/14 57/80
4,332,130 A * 6/1982 Gasser ..... B65H 51/16 226/97.1
4,584,833 A * 4/1986 Dykast ..... D01H 13/14 57/405
5,323,599 A * 6/1994 Wassenhoven ..... D01H 7/90 57/333
5,611,195 A * 3/1997 Lovas ..... D01H 13/005 57/264
5,613,280 A * 3/1997 Mandl ..... D01G 31/006 19/0.26
5,966,919 A * 10/1999 Tsou ..... B65H 59/40 57/264
6,009,700 A * 1/2000 Wassenhoven ..... D01H 4/08 57/263
7,104,040 B2 * 9/2006 Bertoli ..... B65H 54/705 57/350
2007/0095043 A1 5/2007 Puaux

* cited by examiner

*Primary Examiner* — Khoa D Huynh
*Assistant Examiner* — Grace Huang
(74) *Attorney, Agent, or Firm* — Schwartz Law Firm, P.C.

(57) ABSTRACT

A textile machine includes a protective exterior cover, a slotted yarn access formed in the protective cover, and a safety guard shielding at least a portion of the slotted yarn access. The safety guard includes a guard body mounted to the protective cover proximate the slotted yarn access. The guard body has a fastener edge residing adjacent a first side of the slotted yarn access, and a free edge residing adjacent a second side of the slotted yarn access. The free edge of the guard body extends above and across the slotted yarn access and forms an unobstructed space on the second side of the slotted yarn access allowing yarn to pass around the free edge, underneath the safety guard and through the protective cover.

14 Claims, 6 Drawing Sheets

SAFETY GUARD FOR TEXTILE MACHINES

TECHNICAL FIELD AND BACKGROUND OF THE DISCLOSURE

The present disclosure relates broadly and generally to textile machines; and more particularly, to textile machines which incorporate rotating spindles, shafts and other moving parts. Such textile machines commonly incorporate an arcuate (or bent) exterior metal cover. The protective cover defines an opening or access through which yarn passes to the underlying machine. In one exemplary embodiment, the present safety guard effectively shields the yarn access to block inadvertent entry of any loose-hanging excess yarn or other debris which may create a safety hazard to the machine operator.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a textile machine including a protective exterior cover, a slotted yarn access formed in the protective cover, and a safety guard shielding at least a portion of the slotted yarn access. The safety guard is adapted to block inadvertent entry of debris through the protective cover and into underlying moving parts of the textile machine. The safety guard comprises a guard body mounted to the protective cover proximate the slotted yarn access. The guard body has a fastener edge residing adjacent a first side of the slotted yarn access, and a free edge residing adjacent a second side of the slotted yarn access. The guard body defines at least one fastener hole in its fastener edge. A spacer is located between the guard body and the protective cover on the first side of the slotted yarn access. The free edge of the guard body extends above and across the slotted yarn access and forms an unobstructed space on the second side of the slotted yarn access allowing yarn to pass around the free edge, underneath the safety guard and through the protective cover. A fastener extends through the fastener hole and mounts the safety guard to the protective cover.

According to another exemplary embodiment, the guard body comprises a thin rigid metal plate.

According to another exemplary embodiment, the guard body further defines an intermediate see-through observation window located between the fastener edge and the free edge.

According to another exemplary embodiment, the guard body comprise a thin flexible plate.

According to another exemplary embodiment, the flexible plate comprises a substantially transparent see-through plastic.

According to another exemplary embodiment, the spacer comprises a separately-formed cylindrical spacer carried on the fastener.

[polo] According to another exemplary embodiment, the spacer is integrally molded with an underside of the guard body.

According to another exemplary embodiment, the integrally molded spacer comprises an elongated rib extending substantially perpendicular to a longitudinal axis of the guard body.

According to another exemplary embodiment, the free edge of the guard body is inwardly-curved towards the slotted yarn access, such that the free edge promotes self-threading of the yarn past the safety guard and through the slotted yarn access to the underlying textile machine. The term "inwardly-curved" means that at least a portion of the free edge of the guard body curves inwardly towards the slotted yarn access—the "free edge" of the guard body being defined as that portion which extends immediately adjacent the first side the slotted yarn access to the second side of the slotted yarn access.

According to another exemplary embodiment, the guard body resides between 0.125 and 0.500 inches above a surface of the protective cover on the second side of the slotted yarn access.

In another exemplary embodiment, the present disclosure comprises a method for shielding at least a portion of a slotted yarn access formed in a protective cover of a textile machine to block inadvertent entry of debris. The method includes mounting a fastener edge of a safety guard to the protective cover on a first side of the slotted yarn access. An inwardly-curved free edge of the safety guard extends above and across the slotted yarn access and forms an unobstructed space on a second side of the slotted yarn access allowing yarn to pass around the free edge, underneath the safety guard and through the protective cover. The safety guard is oriented relative to the slotted yarn access, such that the inwardly-curved free edge promotes self-threading of the yarn past the safety guard and through the protective cover to the underlying textile machine.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
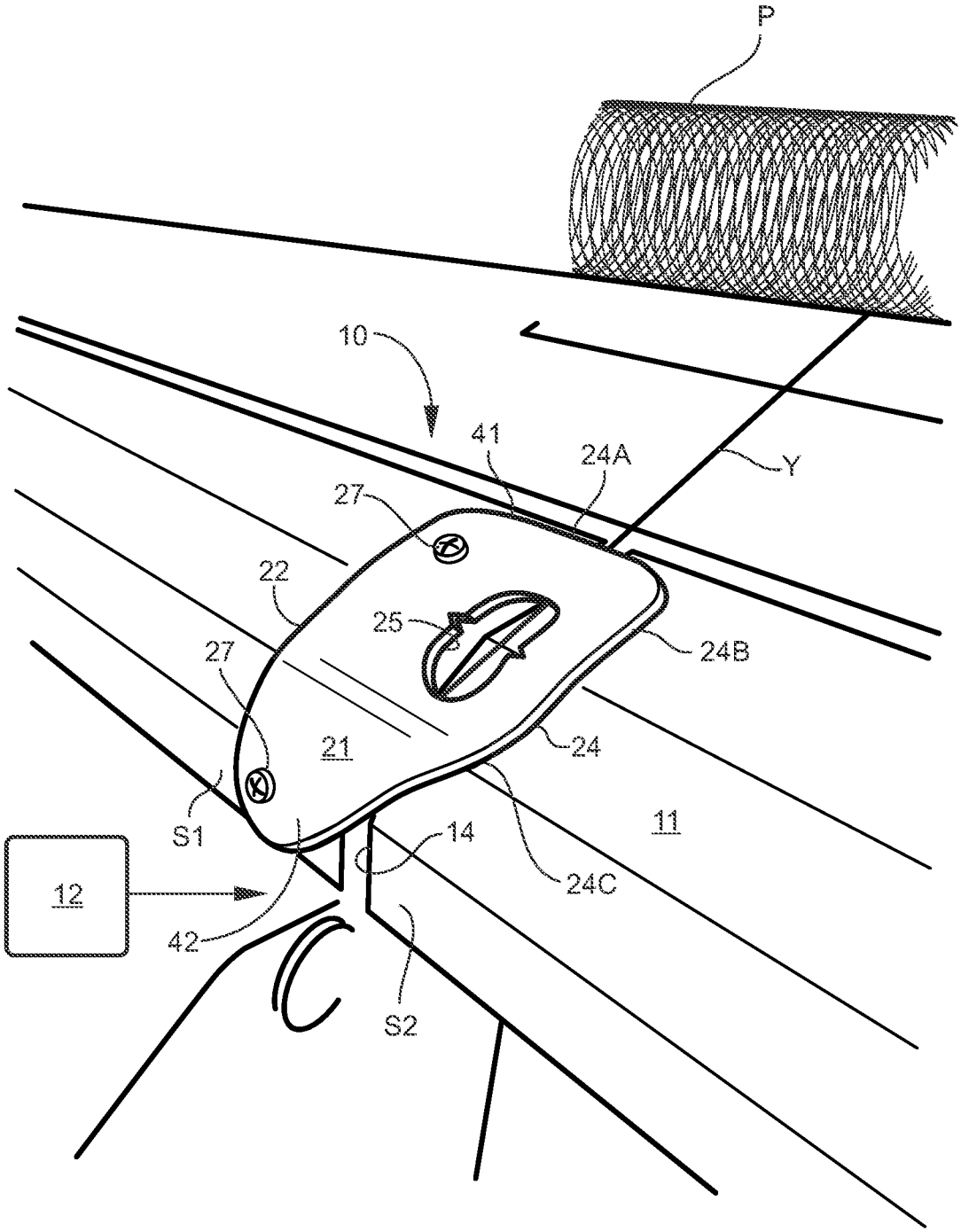
FIG. 1 is an environmental perspective view of a textile safety guard according to one exemplary embodiment of the present disclosure.
Figure 2:
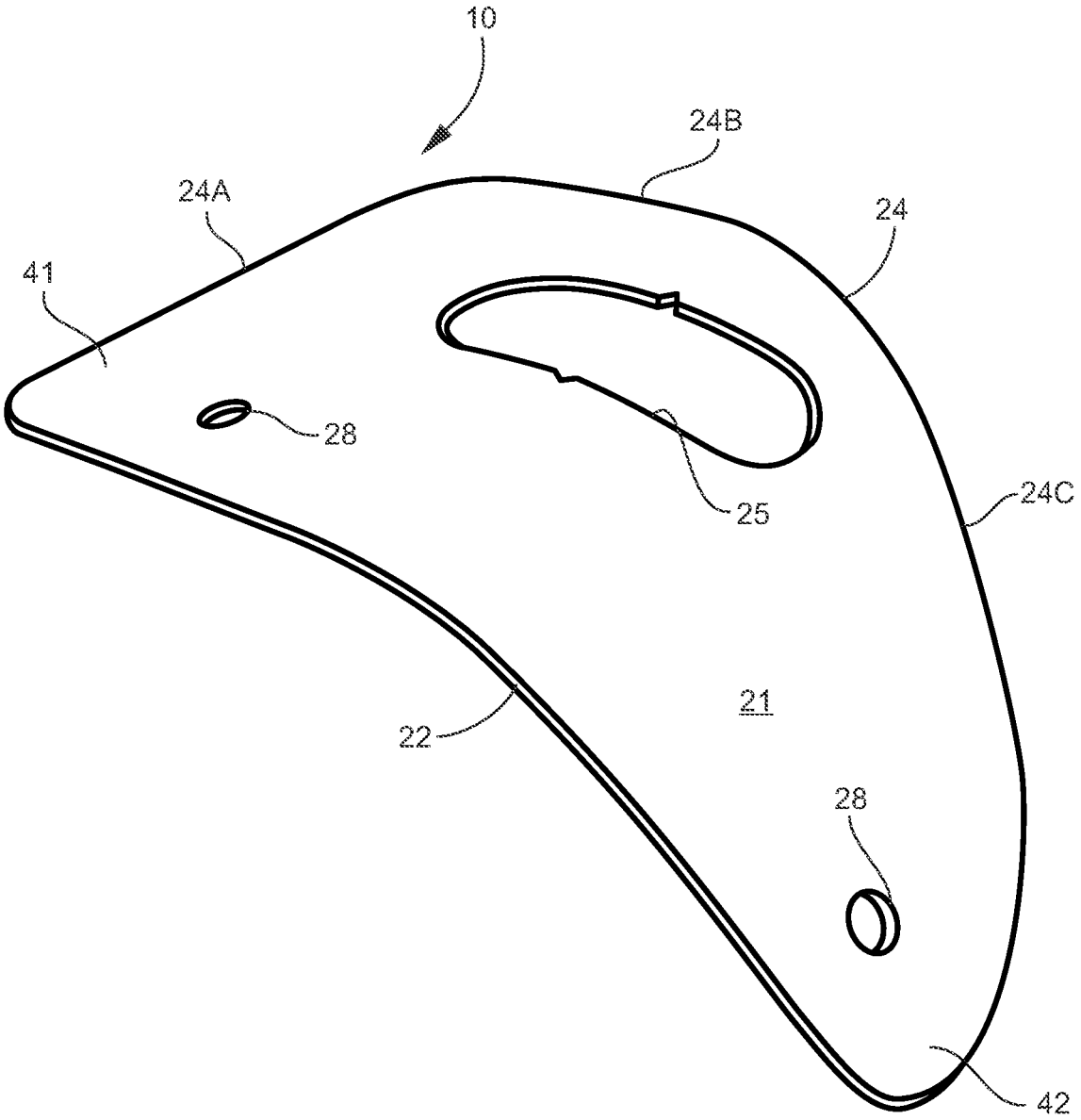
FIG. 2 is a top perspective view of the exemplary safety guard.
Figure 3:
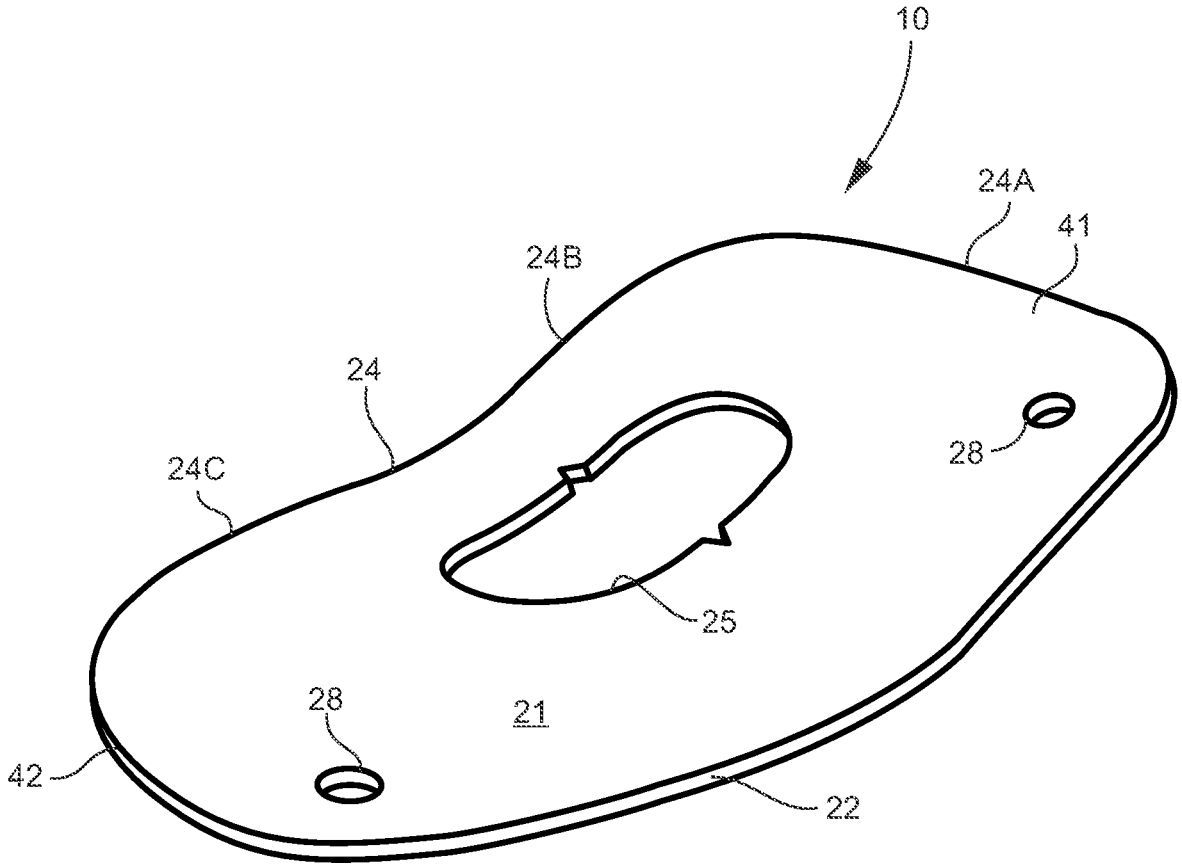
FIG. 3 is a bottom perspective view of the exemplary safety guard.

Referring now specifically to the drawings, a safety guard for textile machines according to one exemplary embodiment of the present disclosure is illustrated in FIGS. 1-3, and shown generally at broad reference numeral 10. The exemplary safety guard 10 is especially applicable for mounting on the protective bent metal cover 11 of an underlying textile machine (represented generally at block 12), such as a yarn cabling/twisting machine. One example of such a machine 12 is disclosed in the published application, U.S. Publication No. 2007/0094053 entitled "Machine for Yarn Cabling/Twisting and Continuous Setting" owned by Rieter Textile Machinery in France. The complete disclosure of this published application is incorporated herein by reference. The present safety guard 10 is located adjacent a slotted yarn access 14 formed in the protective cover, and functions to shield at least a portion of the access 14 to block inadvertent entry of debris through the protective cover 11 and into underlying moving/rotating parts of the textile machine 12. As best shown in FIG. 1, in the exemplary embodiment an end of yarn "Y" is drawn by an elevated package "P" from a rotating interior spindle (not shown) of textile machine 12 below the protective cover 11. The yarn "Y" passes through the slotted yarn access 14 in the cover 11 beneath the safety guard 10.

Figure 4:
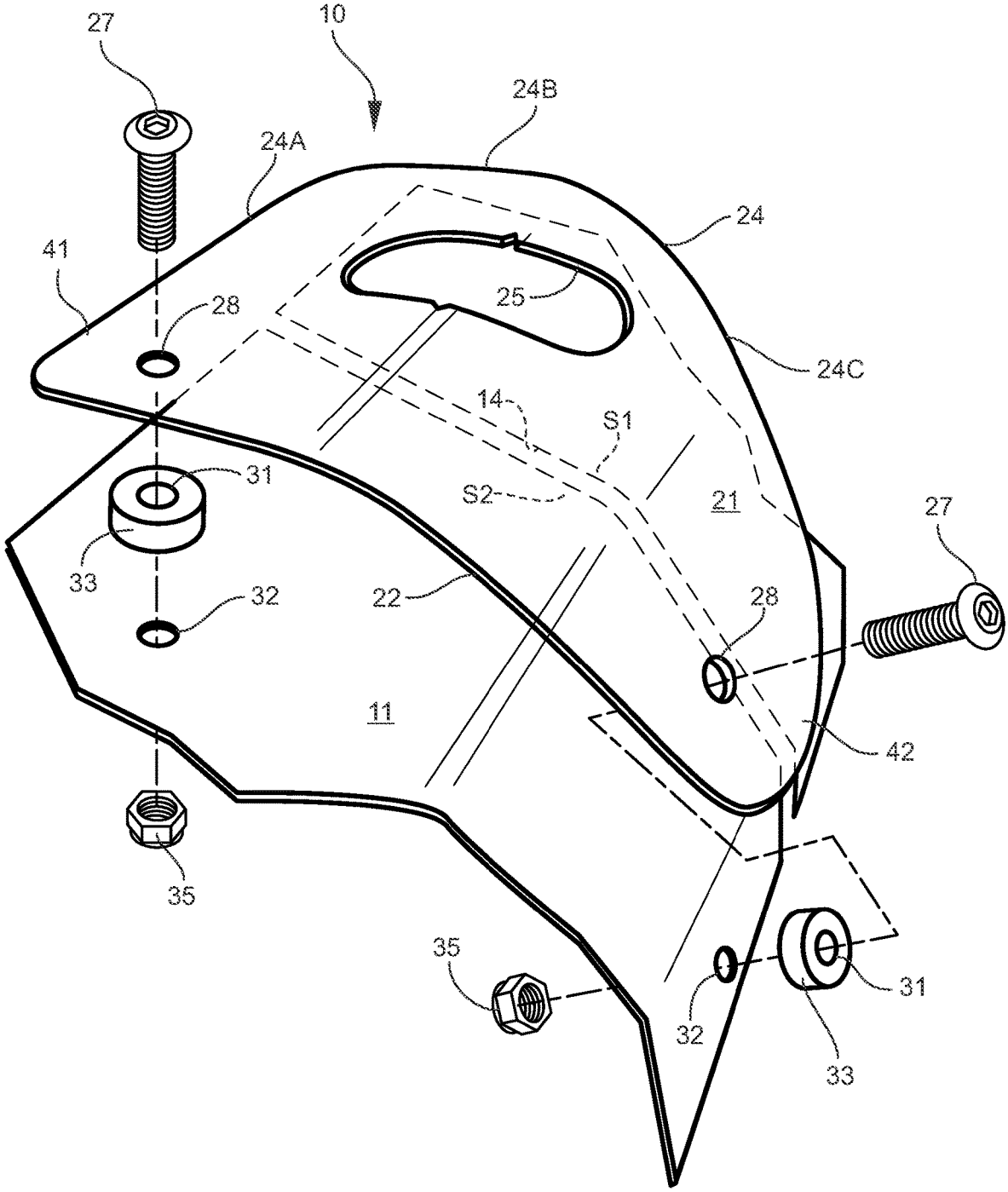
FIG. 4 is a perspective view of the exemplary safety guard with various mounting elements exploded from the protective machine cover.

Referring to FIGS. 1-4, the exemplary safety guard 10 mounts to the protective cover 11 proximate the slotted yarn access 14, as previously described, and comprises a thin contoured metal body 21 (e.g., plate) having a relatively straight fastener edge 22 and an opposing inwardly-curved free edge 24. In this embodiment, an intermediate see-through observation window 25 (e.g., cutout) may be located between the fastener edge 22 and the free edge 24. The fastener edge 22 resides adjacent a fastener side "S1" of the slotted yarn access 14, and defines spaced-apart circular fastener holes 28 designed to receive threaded fastener bolts 27. As best shown in FIG. 4, the fastener bolts 27 extend through respective fastener holes 28 of the guard body 21, and through corresponding aligned holes 31, 32 formed in cylindrical spacers 33 and the protective cover 11. The spacers 33 reside between the guard body 21 and the protective cover 11. Complementary-threaded nuts 35 mate with threaded ends of the fastener bolts 27 on an inside surface of the protective cover 11, and function to secure the safety guard 10 in position adjacent an outside surface of the cover 11 proximate the slotted yarn access 14.

The free edge 24 of the guard body 21 extends above and across the slotted yarn access 14, and forms an unobstructed space between the safety guard 10 and protective cover 11 on a free side "S2" of the slotted yarn access 14. The guard body 21 may reside between 0.125 and 0.500 inches above the outside surface of the protective cover 11 on the free side "S2" of the slotted yarn access 14. When threading-up the textile machine 12, this unobstructed space allows yarn "Y" to pass freely around the free edge 24 of the guard body 21, underneath the safety guard 10 and through the protective cover 11. The geometric bend of the safety guard 10 and inwardly-curved free edge 24 promotes self-threading of the yarn "Y" past the guard body 21 and through the slotted thread access 14 to the underlying textile machine 12. In the one embodiment, the free edge 24 of the guard body 21 has a relatively straight top portion 24A which extends from the fastener side "S1" of the slotted yarn access 14, across the slotted yarn access 14 at a top end 41 of the safety guard 10, a gently curved upper side portion 24B extending generally perpendicular to the top portion 24A on the free side "S2" of the yarn access 14, and a lower side/bottom portion 24C which curves inwardly from the upper side portion 24B curving across the slotted yarn access 14 at a bottom end 42 of the safety guard 10 on the fastener side "S1" of the yarn access 14. The exemplary safety guard 10 is relatively wide at its top end 41, and relatively narrow (or pointed) at its bottom end 42—with the bottom end 42 residing substantially on the fastener side "S1" of the slotted yarn access 14.

Figure 5:
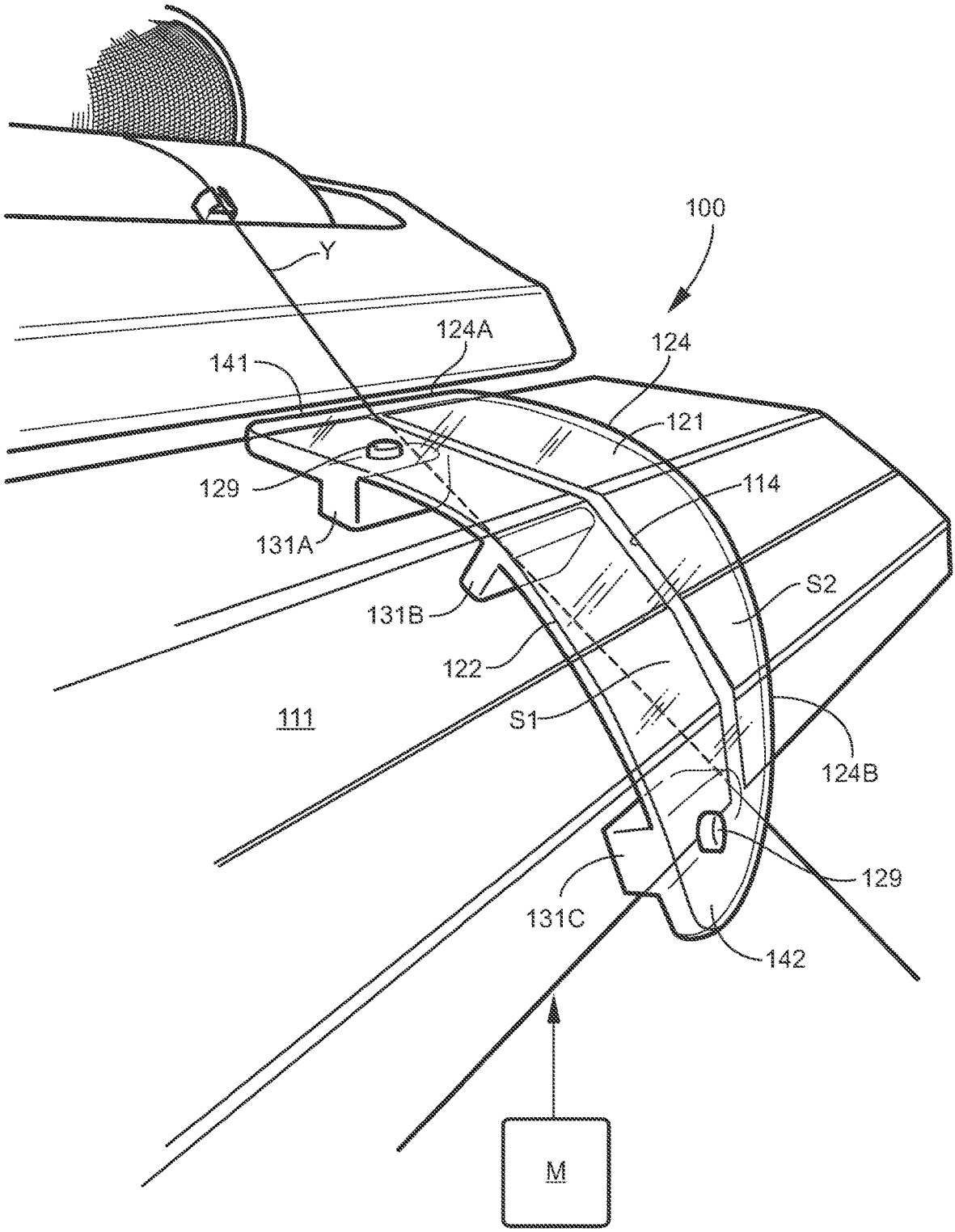
FIG. 5 is environmental perspective view of a flexible safety guard according to a second exemplary embodiment of the present disclosure, and showing the safety guard flexed and mounted to the protective cover of a textile machine.
Figure 6:
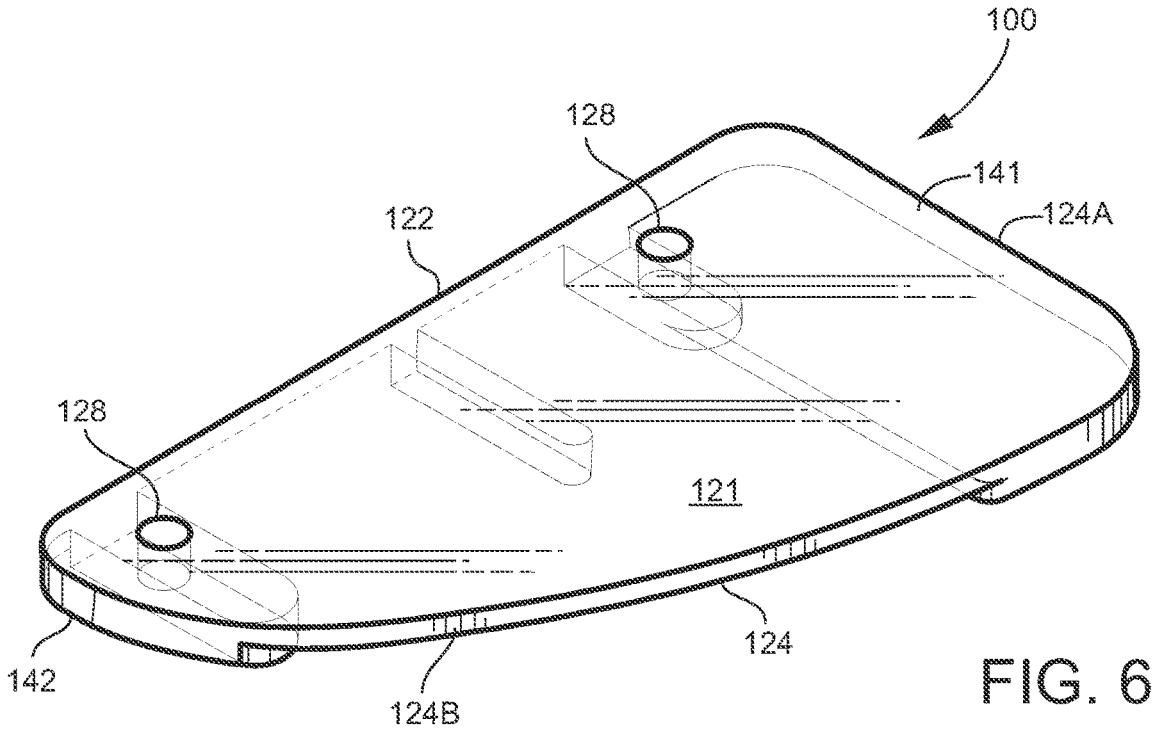
FIG. 6 is a top perspective view of the exemplary safety guard in a relaxed condition.
Figure 7:
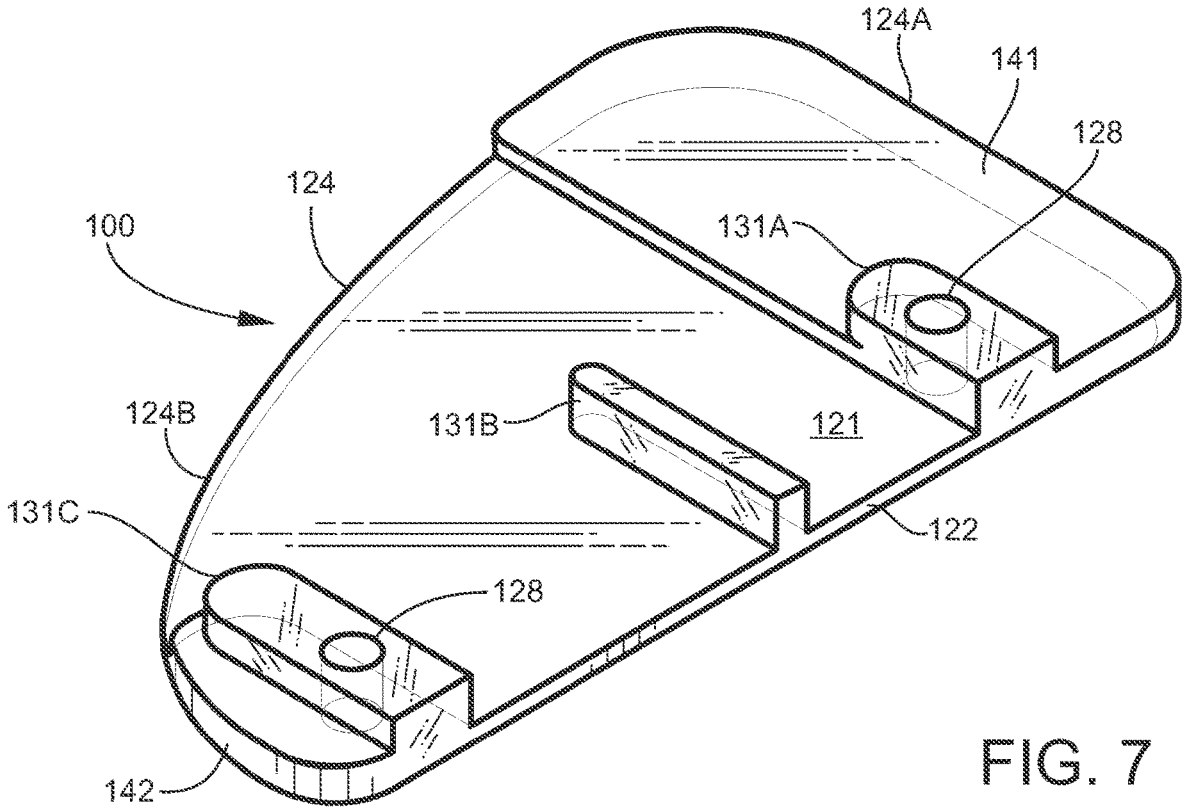
FIG. 7 is a bottom perspective view of the exemplary safety guard in the relaxed condition.

A further exemplary embodiment of the present safety guard 100 is illustrated in FIGS. 5-7. As previously described, the exemplary safety guard 100 mounts to the protective metal cover 111 proximate the slotted yarn access 114, and functions to block inadvertent entry of debris through the protective cover 111 and into underlying moving/rotating parts of the textile machine "M". The safety guard 100 comprises a thin flexible body 121 (e.g., plate) constructed of a substantially transparent see-through plastic, and comprises a relatively straight fastener edge 122 and an opposing inwardly-curved free edge 124. The fastener edge 122 resides adjacent a fastener side "S1" of the slotted yarn access 114, and defines spaced-apart circular fastener holes 128 designed to receive threaded fastener bolts 129 or other suitable mounting hardware. In this embodiment, integrally-molded spacer ribs 131A, 131B, 131C are formed on an underside of the flexible guard body 121, and reside between the guard body 121 and protective cover 111. The spacer ribs 131A-131C extend substantially perpendicular to a longitudinal axis of the guard body 111, and are designed to reside adjacent the protective cover 111 only on the fastener side "S1" of the slotted yarn access 114. The fastener holes 128 are sufficiently spaced-apart such that the plastic guard body 121 readily flexes when mounted to conform the safety guard 100 to the bent walls of the protective cover 111.

The free edge 124 of the guard body 121 extends above and across the slotted yarn access 114, and forms an unobstructed space between the safety guard 100 and protective cover 111 on a free side "S2" of the slotted yarn access 114. As previously described, this unobstructed space allows yarn "Y" to pass freely around the free edge 124 of the guard body 121, underneath the safety guard 100 and through the protective cover 111. The geometric bend of the safety guard 100 and inwardly-curved free edge 124 promotes self-threading of the yarn "Y" past the guard body 121 and through the slotted thread access 114 to the underlying textile machine "M". Like safety guard 10, the free edge 124 of the guard body 121 has a relatively straight top portion 124A which extends across the slotted yarn access 114 at a top end 141 of the safety guard 100. As best shown in FIG. 7, the top end 141 may be uniformly thick between the fastener edge 122 and the free edge 124 for strength reinforcement. A gently curved side portion 124B of the free edge 124 extends from the top portion 124A on the free side "S2" of the slotted yarn access 114, and curves across the slotted yarn access 114 at a bottom end 142 of the safety guard 100 to the fastener side "S1" of the yarn access 114. Like the top end 141 of safety guard 100, the bottom end 142 may be uniformly thick between the fastener edge 122 and the free edge 124 for strength reinforcement. The area of the safety guard 100 between the top and bottom ends 141, 142 may be uniformly thinner to promote increased flexibility.

In each of the above embodiments, the relative width and geometry of the safety guard may vary depending upon the cross-sectional shape of the protective cover and dimensions of the yarn access. Additionally, the exemplary safety guard may permanently or releasably mount to the protective cover by means other than hardware, including (e.g.) adhesives, magnets, or other fixed or releasable means.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A textile machine comprising a protective exterior cover, a slotted yarn access formed in said protective cover, and a safety guard located on an exterior of said protective cover and shielding at least a portion of said slotted yarn access and adapted to block inadvertent entry of debris through said protective cover and into underlying moving parts of said textile machine, said safety guard comprising:

a guard body extending parallel to the exterior of said protective cover proximate said slotted yarn access and having a fastener edge residing adjacent a first side of said slotted yarn access on the exterior of said protective cover and a free edge residing adjacent a second side of said slotted yarn access on the exterior of said protective cover;

said guard body defining at least one fastener hole in said fastener edge;

a spacer located between said guard body and the exterior of said protective cover on the first side of said slotted yarn access, such that the free edge of said guard body extends above and across said slotted yarn access and forms an unobstructed space on the second side of said slotted yarn access allowing yarn to pass around the free edge, underneath said safety guard and through said protective cover; and a fastener extending through said at least one fastener hole and mounting said safety guard to said protective cover.

2. The textile machine according to claim 1, wherein said guard body comprises a rigid metal plate.

3. The textile machine according to claim 2, wherein said guard body further defines an intermediate see-through observation window located between said fastener edge and said free edge.

4. The textile machine according to claim 1, wherein said guard body comprise a flexible plate.

5. The textile machine according to claim 4, wherein said flexible plate comprises a transparent see-through plastic.

6. The textile machine according to claim 1, wherein said spacer comprises a separately-formed cylindrical spacer carried on said fastener.

7. The textile machine according to claim 1, wherein said spacer is integrally molded with an underside of said guard body.

8. The textile machine according to claim 7, wherein said integrally molded spacer comprises an elongated rib extending perpendicular to a longitudinal axis of said guard body.

9. The textile machine according to claim 1, wherein the free edge of said guard body is inwardly curved towards said slotted yarn access, such that the free edge promotes self-threading of the yarn past the safety guard and through the slotted yarn access to the underlying textile machine.

10. The textile machine according to claim 1, wherein said guard body resides between 0.125 and 0.500 inches above a surface of said protective cover on the second side of said slotted yarn access.

11. A textile machine comprising a protective exterior cover, a slotted yarn access formed in said protective cover, and a safety guard located on an exterior of said protective cover and shielding at least a portion of said slotted yarn access; and adapted to block inadvertent entry of debris through said protective cover and into underlying moving parts of said textile machine, said safety guard comprising:

a rigid metal guard body extending parallel to the exterior of said protective cover proximate said slotted yarn access; and having a fastener edge residing adjacent a first side of said slotted yarn access on the exterior of said protective cover and a free edge residing adjacent a second side of said slotted yarn access on the exterior of said protective cover;

said guard body defining at least one fastener hole in said fastener edge, and an intermediate see-through observation window located between said fastener edge and said free edge;

a spacer located between said guard body and the exterior of said protective cover on the first side of said slotted yarn access, such that the free edge said guard body extends above and across said slotted yarn access and forms an unobstructed space on the second side of said slotted yarn access allowing yarn to pass around the free edge, underneath said safety guard and through said protective cover; and a fastener extending through said fastener hole and mounting said safety guard to said protective cover.

12. The textile machine according to claim 11, wherein said spacer comprises a separately-formed cylindrical spacer carried on said fastener.

13. The textile machine according to claim 11, wherein the free edge of said guard body is inwardly curved towards said slotted yarn access, such that the free edge promotes self-threading of the yarn past the safety guard and through the slotted yarn access to the underlying textile machine.

14. The textile machine according to claim 11, wherein said guard body resides between 0.125 and 0.500 inches above a surface of said protective cover on the second side of said slotted yarn access.

* * * * *